US005826873A

United States Patent [19]

Lavermicocca

[11] Patent Number: 5,826,873

[45] Date of Patent: Oct. 27, 1998

[54] THREE DIMENSIONAL PUZZLES

[75] Inventor: Giovanni Lavermicocca, New South Wales, Australia

[73] Assignee: Interlock Marketing Pty. Ltd., Balmoral, Australia

[21] Appl. No.: 750,766

[22] PCT Filed: Jun. 16, 1994

[86] PCT No.: PCT/AU94/00329

§ 371 Date: Dec. 13, 1996

§ 102(e) Date: Dec. 13, 1996

[87] PCT Pub. No.: WO95/34354

PCT Pub. Date: Dec. 21, 1995

[51] Int. Cl.[6] ..... A63F 9/12

[52] U.S. Cl. ..... 273/157 R; 273/160

[58] Field of Search ..... 273/153 R, 157 R, 273/160, 156

[56] References Cited

U.S. PATENT DOCUMENTS

| | | | |
|---|---|---|---|
| D. 215,949 | 11/1969 | Markusen | 273/160 |
| 343,516 | 6/1886 | Collins et al. | 273/160 |
| 1,546,024 | 7/1925 | Reichenbach . | |
| 2,201,724 | 5/1940 | Gable | 273/160 |
| 2,574,158 | 11/1951 | Sullivan . | |
| 3,829,101 | 8/1974 | Betzoldt | 273/160 |
| 4,198,053 | 4/1980 | Rao . | |
| 4,683,792 | 8/1987 | Demont . | |
| 4,779,497 | 10/1988 | Lee . | |
| 5,040,797 | 8/1991 | Dykstra . | |
| 5,230,508 | 7/1993 | Tabler | 273/157 R |

FOREIGN PATENT DOCUMENTS

| | | | |
|---|---|---|---|
| A1-0 097 992 | 1/1984 | European Pat. Off. . | |
| A-2550-125 | 2/1985 | France . | |
| 244016 | 12/1925 | United Kingdom | 273/160 |
| 1242942 | 8/1971 | United Kingdom | 273/160 |
| A-2 118 845 | 11/1983 | United Kingdom . | |
| WO 80/01990 | 10/1980 | WIPO . | |
| WO 91/04084 | 4/1991 | WIPO . | |

*Primary Examiner*—Steven B. Wong

*Attorney, Agent, or Firm*—Panitch Schwarze Jacobs & Nadel, P.C.

[57] ABSTRACT

The invention provides a three-dimensional puzzle consisting of a plurality of interlocking components. Each component has at least one engagement surface with which it engages with one or more other components. The puzzle includes at least three components in which the first and second components engage and the third component engages both first and second components and prevents their disengagement from each other whilst engaged with the third component. Further, there is provided a device for hot wire cutting of thermoplastic material comprising an electrically conductive wire, an arrangement for driving the wire between two points, and a voltage arrangement for applying a potential difference to the wire between the two points.

12 Claims, 6 Drawing Sheets

THREE DIMENSIONAL PUZZLES

TECHNICAL FIELD

This invention relates to puzzles and more particularly to 3-dimensional puzzles. By three dimensional puzzles we mean puzzles that extend in three dimensions comprised of a number of pieces which, when assembled, form a complete unit.

BACKGROUND ART

Known 3-dimensional puzzles include a barrel comprised of a number of pieces. The pieces are shaped to fit together with a locking member holding all the pieces together. The disadvantage of such puzzles which utilise a locking member is that on removal of the locking member, the remaining pieces fall apart. This is because the pieces do not lock into each other in a manner similar to the pieces of a 2-dimensional jig-saw puzzle. Instead the pieces are merely shaped to be complementary to each other and do not "lock" to each other—hence the need for a locking member to hold all pieces together.

Such puzzles have the disadvantage that, when assembled, removal of the locking piece will result in the assembly falling apart. Similarly, when assembling the pieces it is sometimes difficult to maintain the pieces together as the partially completed assembly is moved and rotated.

DISCLOSURE OF THE INVENTION

In an attempt to overcome the disadvantages of the prior art, the invention, in one broad form, comprises a three dimensional puzzle consisting of a plurality of three dimensionally shaped components which engage together, the plurality of components comprising:

- a first and second components engaging on first and second engagement surfaces and defining, when engaged in correct position, a third engagement surface;
- a third component having a fourth engagement surface, which engages the 1st and 2nd components by engagement of the third and fourth engagement surfaces;
- wherein, when the first, second and third components are engaged together, the first and second components cannot be disengaged without removing them from the third component.

The first and second component preferably engage by movement along one or two axes. A simple tongue and groove arrangement may be utilised so the pieces may slide along the longitudinal direction of the tongue and groove arrangement or be moved perpendicularly to the longitudinal direction. More preferably the tongue and groove arrangement is of a reentrant type such that engagement can only be achieved by sliding along the longitudinal axis.

Similar engagement surfaces may be utilised to connect the third component to the first and second components.

Some or all of the components may be multi piece components. The pieces of each multi piece component may merely abut or may engage with one or two degrees of freedom. Preferably each piece of the component forms art of an engagement surface, so that when the component is engaged with another component, the pieces are located in place.

Where reentrant tongue and groove arrangements are utilised to engage components or pieces together, the tongue and groves may be tapered so that engagement can only occur by sliding in one direction, as opposed in either direction.

The invention also provides in one broad form a device for hot wire cutting of the thermoplastic material, the device comprising:

- an electrically conductive wire extending lengthways between two points;
- drive means to drive the wire lengthways between the two points; and,
- voltage means for applying a potential voltage difference to the wire at the two points.

The separation of the two points may be adjusted to accommodate different sized material.

The voltage applied to the wire may be varied to adjust for change in separation and the type of material being cut. Similarly the tension and wire speed may also be adjusted, depending on the material.

The wire may be a continuous loop or a strand which is run from a supply spool to a take-up spool. When all the wire has been passed to the take-up spool, the spools may be swapped with the take-up spool becoming the supply spool.

The device may be a hand held device which is moved to cut the material. Alternatively the device may be fixed and the material moved. With a fixed device, a bed to rest the material is preferable, through which the wire passes. The angle of the wire to the bed may be fixed or it may be variable. If the angle is fixed, it is best if the wire is perpendicular to the bed.

BEST MODES FOR CARRYING OUT THE INVENTION

The invention shall be better understood from the following description of non-limiting embodiments of the invention.

Figures 1, 2:
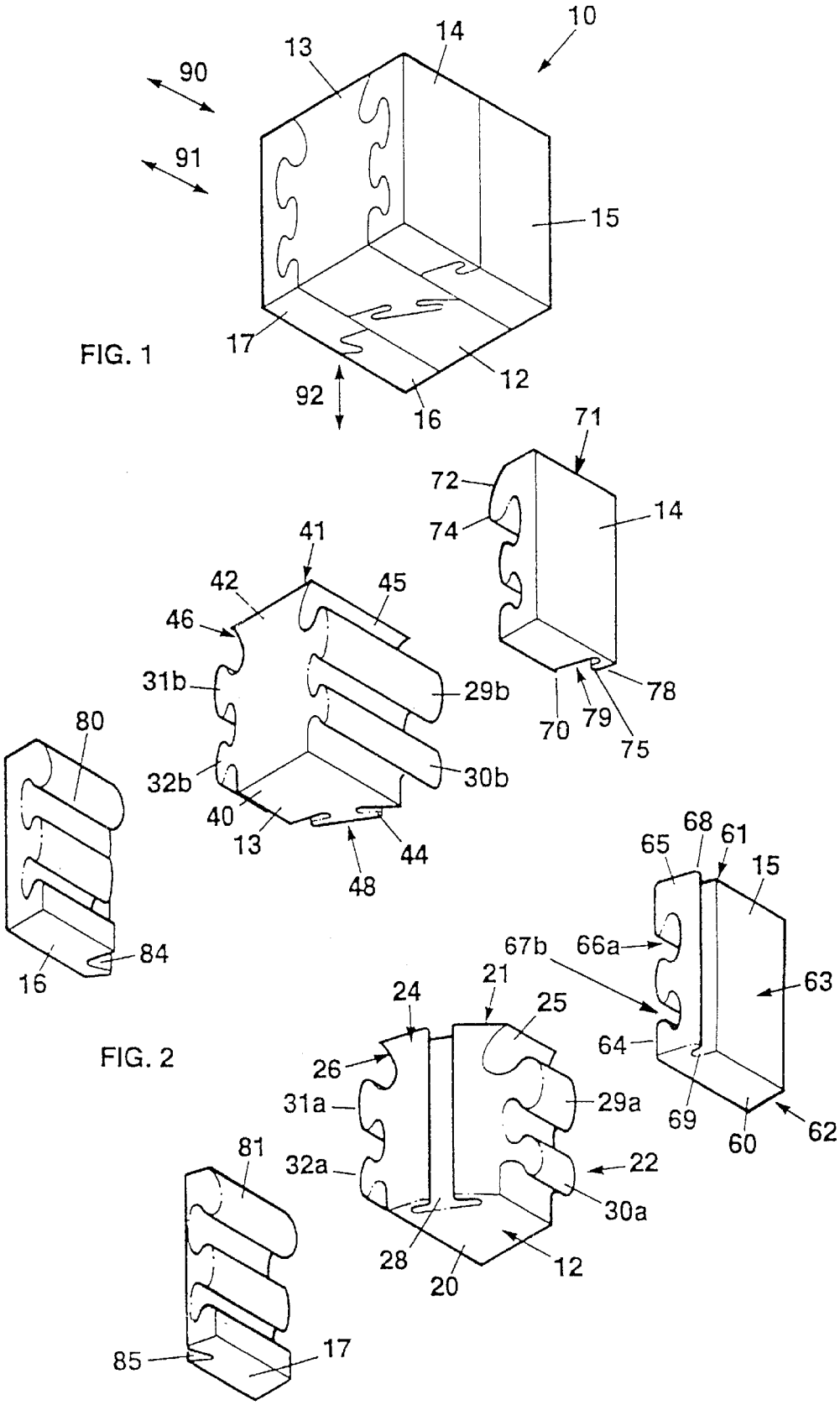
FIG. 1: shows a first embodiment of the invention in the assembled form
FIG. 2: shows the component pieces of the embodiment of FIG. 1

Referring to FIG. 1, there is shown a three dimensional puzzle 10 in the shape of a cube. The puzzle 10 is comprised of six component pieces, 12, 13, 14, 15, 16 and 17.

The six pieces may be considered as three pairs 12+13, 14+ 15, and 16+17 as will be explained below. However, this pairing is merely preferred and in other forms of the invention the component pieces may be unpaired.

Component piece 12 has parallel external end faces 20 and 21 and perpendicular side face 22, which form part of the external surfaces of the completed cube 10. The piece 12 also has internal surfaces 24, 25 and 26. Internal surface 24 extends between faces 20 and 21 whilst surfaces 25 and 26 extend between face 22 and surface 24.

The surface 24 defines a longitudinally extending slot 28, which is of constant cross-section. However, if desired the cross-section may taper in the longitudinal direction. The slot 28 is a t-shape in cross-section and extends substantially perpendicularly to the end faces 20, 21. However, this is not essential and the slot 28 may be at any angle desired to the faces 20, 21.

The inner surface 25 defines two longitudinally extending tongues 29*a*, 30*a*, each of which is of constant cross-section. Again they may taper in the longitudinal direction. In this case both tongues must taper in the same direction. Each tongue is also a t-shape in the cross-section and extends substantially perpendicularly to the side face 22. If desired the tongues 29*a*, 30*a* may be at any angle to the end face 22, albeit they must be parallel to each other. A single tongue may be provided—two are not essential.

In a similar manner, inner surface 26 also defines two longitudinally extending tongues 31*a*, 32*a*, each of which is of constant cross-section and of a t-shape. Tongues 31*a*, 32*a* extend substantially perpendicularly to end face 22 but again may be at any angle to end face 22. It is not necessary that tongues 13*a*, 32*a* be parallel with tongues 29*a*, 30*a* and again need not be of constant cross-section.

Whilst the tongues 29*a* to 32*a* are of constant cross-section they may change shape in the longitudinal direction, if desired. However both tongues of each pair must change shape in the same direction.

Component piece 13 has parallel external end faces 40, 41 and perpendicular side face 42. The orientation and separation of faces 40 and 41 is the same as that of faces 20 and 21 of piece 12, so when assembled faces 20 and 40 and 21 and 41 respectively form planar surfaces. The piece 13 also has internal surfaces 44, 45 and 46. Internal surface 44 extends between end faces 40, 41 whilst surface 45 and 46 extend between surface 44 and side face 42.

The surface 44 is complementary to surface 24 on piece 12 and so defines a longitudinal t-shaped tongue 48 sized to snugly fit within slot 28. Thus the two pieces 12 and 13 may be joined by sliding tongue 48 lengthways into slot 28, as in FIG. 1. If the cross-section of tongue 48 slot 28 is not constant, it will only be possible to slide the pieces together in one direction.

The inner surface 45 is of a similar configuration to surface 25 of piece 12 and defines two parallel t-shaped longitudinally extending tongues 29*b* and 30*b*. The shape of surface 45 is such that when pieces 12 and 13 are assembled, a single surface with no discontinuities is formed by surfaces 25 and 45. In particular tongues 29*a* and 29*b* align to form a single tongue 29. Similarly tongues 30*a* and 30*b* form tongue 30.

In a similar manner surface 46 has a similar configuration to that of surface 26. It to defines tongues 31*b* and 32*b* which, when assembled, align with tongues 31*a* and 32*b* of piece 12, respectively to form tongues 31 and 32.

Component piece 15 has a parallel external end faces 60, 61, perpendicular side face 62 and upper face 63. Internal surface 64 extends between end faces 60, 61 and internal surface 65 extends from the upper surface to the internal surface 64.

Internal surface 64 is complementary to surfaces 25 and 45 on pieces 12 and 13 respectively. Thus it defines two slots 66*a* and 67*b* to receive tongues 29 and 30, respectively.

The surface 65 is non planar and defines an upstanding tongue 68 and a groove 69. The configuration and alignment of surface 65 to end faces 60, 61 may be at any angle.

Piece 14 also has parallel external end faces 70, 71, side face 72 and upper face 73. Internal surface 74 extends between end faces 70, 71 and internal surface 75 extends from the upper face 73 to the internal surface 74. The internal surface 74 is complementary to surface 65 of piece 15 and so defines an upstanding tongue 78 to engage in groove 69 and a groove 79 to receive tongue 68. In the embodiment of FIG. 1, the configuration of the surfaces 75 and 65 is such that the two pieces may be engaged by overlapping the pieces with end faces 60 and 70 adjacent and moving them perpendicular to upper surfaces 63 and 75. However if the surfaces are re-entrant, the pieces must be slid together. Either configuration may be used. However a re-entrant configuration requires intentional engagement and disengagement. That is the pieces cannot fall apart easily.

Component pieces 16 and 17 are similar to pieces 14 and 15 in that they both have inner surfaces 80, 81 complementary to surfaces 26 and 46. Pieces 16 and 17 engage together upon inner surfaces 84, 85, which, as with pieces 14 and 15, define complementary tongues and grooves. In the configuration shown, the pieces may be engaged without sliding length ways.

It will be appreciated that other configurations may be utilised for the engagement surfaces of pieces 14, 15, 16 and 17.

To assemble the puzzle it is first necessary to join piece 12 to piece 13, piece 14 to piece 15 and piece 16 to piece 17 by engaging the respective tongues, slots and grooves.

Combined pieces 14 and 15 may then be slid onto engagement with combined pieces 12 and 13 by movement parallel to tongues 29 and 30, as indicated by arrow 90. Similarly combined pieces 16 and 17 may slide into engagement with pieces 12 and 13 by movement parallel to tongues 31 and 32 as indicated by arrow 91.

It will be noted that it is not possible to assemble the puzzle without first combining the relevant pairs of piece. For example, if piece 14 is slid onto piece 13 without 15, when piece 15 is slid onto piece 12, it will not be able to slid into position due to surfaces 65 and 75 not mating. Equally, it will be noted that pieces 12 and 13 may not be disengaged until pieces 14–17 are removed. This is because the joining surfaces 24 and 44 of pieces 12 and 13 do not align with surfaces 65 and 70 on pieces 14 and 15 and surfaces 84 and 85 on pieces 16 and 17, but are staggered. If the cut lines formed by these surfaces are aligned, it would be possible to move pieces 12, 15 and 16 together in the direction of arrow 92 relative to pieces 13, 14 and 17. It is this discontinuity in the cut lines of the various pieces that means each piece, or pair must be removed before another piece can be removed.

If desired, mating surfaces 65 and 75 may be plain surfaces, so pieces 14 and 15 may be moved from pieces 12 and 13 independently. This will not effect the stability of the puzzle when assembled, so long as one of the pieces 14 or 15 engages both pieces 12 and 13. Thus, for instance, piece 14 could be removed and piece 15 left in place. Pieces 12 and 13 would still be locked in place by piece 15, which engages both pieces 12 and 13, irrespective of the presence, or otherwise, of pieces 16 and 17. If piece 15 is removed and piece 14 left in position it would not be possible to remove pieces 12 and 13 together, due to pieces 16 and 17 preventing movement of piece 13 relative to piece 12 in direction of arrow 92.

Figure 3:
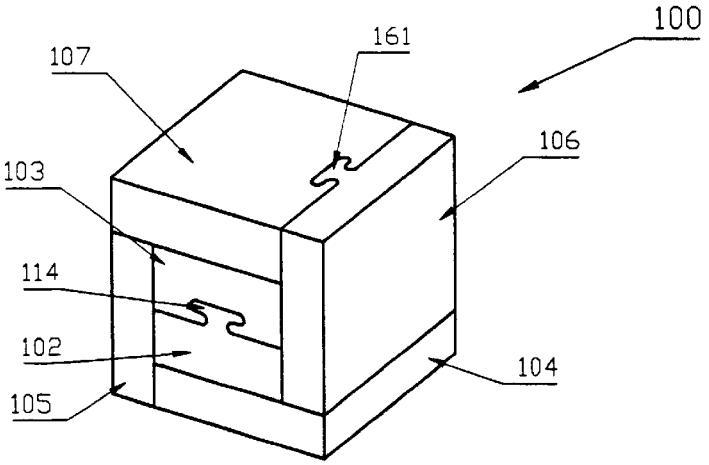
FIG. 3: shows a second embodiment of the invention in the assembled form
Figure 4:
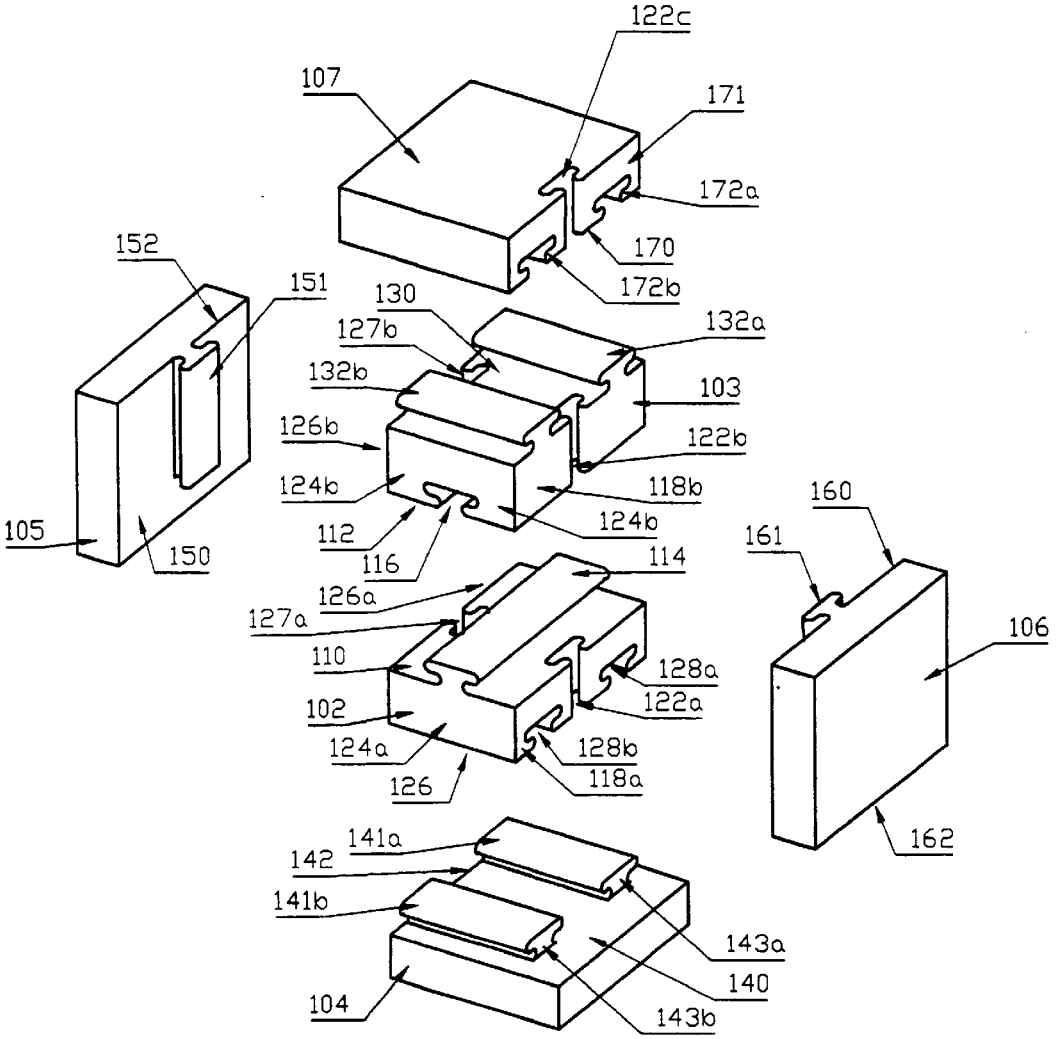
FIG. 4: shows the component pieces of the embodiment of FIG. 2

FIGS. 3 and 4 show a cube 100 according to the invention. The cube 100 is comprised of n components namely pieces

102 to 107, each of which is generally a rectangular slab and may be referred to as an $m^{th}$ component. Pieces 102 and 103 are internal paired pieces whilst pieces 104–107 are external unpaired pieces.

Pieces 102 and 103 have complementary engaging surfaces 110 and 112 respectively. Surface 110 defines a longitudinal t-shaped tongue 114 which engages in complementary longitudinal t-shaped slot 116 defined by surface 112.

Upper surfaces 118*a* and 118*b* of pieces 102, 103 respectively are generally planar, each having a t-shaped slots 122*a* and 122*b*, therein respectively. When pieces 102 and 103 are engaged surface 118*a* and 118*b* define a single planar surface 118 with a single slot 122 running therethrough. Of course the surface 118 and slot 122 may be at any angle relative to side walls 124.

Lower surfaces 126*a*, 126*b* of pieces 102 and 103 respectively are confined similarly to surfaces 118*a*, 118*b*, each having a t-shaped slot 127*a*, 127*b* which forms a single slot 127 when the pieces 102 and 103 are engaged.

Piece 102 has a surface 126 which extends generally perpendicularly to wall 124*a* and upper surface 118*a*, but need not be. This surface 126 defines two parallel longitudinally extending t-shaped slots 128*a* and 128*b*. These extend parallel to side wall 124*a*, but may be at any angle.

Piece 103 has a surface 130 which extends generally perpendicularly to side wall 124*b* and upper surface 118*b*. This surface 130 has two upstanding parallel t-shaped tongues 132*a* and 132*b* which extend generally perpendicularly to surface 118*b*. Again surface 130 and tongues 132*a* and 132*b* may be at any angle.

Piece 104 is a generally planar slab having an inner surface 140. Extending from this surface 140 are two parallel t-shaped tongues 141*a* and 141*b* which are complementary to slots 128*a* and 128*b* in surface 126. Tongues 141*a*, 141*b* extend from the lower edge 142 part way up surface 140 so as to end with their upper faces 143*a*, 143*b* co-planar with upper surfaces 118*a* and 118*b* on pieces 102 and 103 respectively.

Piece 105 has an inner surface 150 having a single t-shaped tongue 151 which is complementary to groove 127. This tongue 151 extends from the leftwards edge 152 part way across the surface 150 to bear against surface 140 of piece 104 when assembled.

Piece 106 has a lower surface 160 which has a t-shaped tongue 161 which extends across the full width of surface 160. Tongue 161 is complementary to slot 122 and when assembled the right hand edge 162 bears against the planar portion of surface 140.

Finally piece 107 is also a generally planar slab having an inner surface 170 and an upper surface 171. The upper surface 171 has a slot 122*c*, which, when assembled, is a continuation of slots 122*a* and 122*b* in pieces 102 and 103. Tongue 161 of piece 106 also engages in slot 122*c*.

The inner surface 171 has two parallel t-shaped slots 172 and 172*b* which are complementary to t-shaped tongues 132*a* and 132*b* respectively. Piece 107 extends downwards below piece 103 so it is not essential that slots 172*a* and 172*b* extend the full height of the surface 170—if desired they may end at the level of the lower surface 126.

To assemble the puzzle, the two pieces 102 and 103 are joined by sliding tongue 114 into slot 116. Next pieces 105 or 107 are engaged with pieces 102 and 103 by sliding tongue 151 into slot 127 and tongues 132 and 132*b* in to slots 172*a* and 172*b* respectively. The order in which pieces 105 and 107 are engaged is not important because they do not engage each other. Of course if tongue 151 extended leftwards into a complementary slot in piece 107, piece 107 would need placing before piece 105.

Next pieces 104 and 106 are engaged. Although neither engages with the other, the order of assembly is important. Piece 104 must be slid into position before piece 106, otherwise piece 106 will block access of tongues 141*a* and 141*b* to slots 128*a* and 128*b*. As with pieces 105 and 107, if desired, pieces 104 and 106 may be made to engage with each other.

Disassembly of the cube is merely a reversal of the assembly steps.

It will be apparent from the above description that the provision of the tongues and grooves on the engagement surfaces ensures that the assembly cannot fall apart by accident—it is necessary that each piece be removed from engagement with one or more adjacent pieces before other pieces can be removed. Furthermore, when one or more pieces have been removed the remaining pieces still remain in position.

Referring to FIGS. 5 to 19, there is shown a sphere 300 constructed according to the invention. The sphere 300 is comprised of a plurality of components, numbered 310 to 326 and each shown in FIGS. 10 to 12 and 14 to 19.

Components 310, 312 and 314 engage to form a core 306 which is shown in FIGS. 5 to 9. Components 316 to 326 then engage on the core 306 to form the completed sphere 300.

Figure 10:
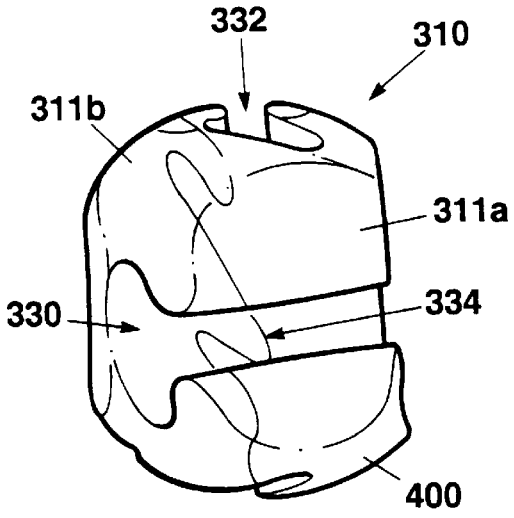
FIGS. 10 to 12: each show a component of the assembly of FIG. 5
Figure 11:
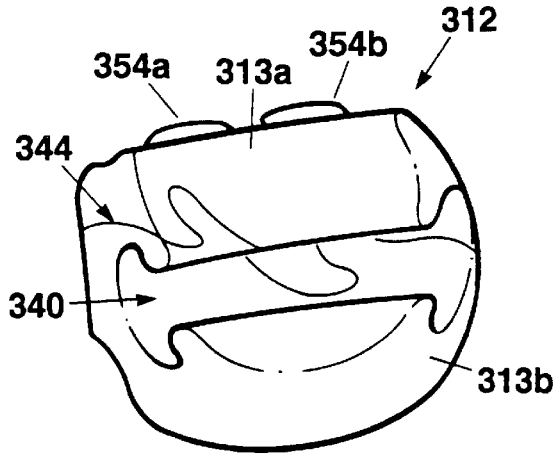

Referring to FIG. 10, component 310 has a first longitudinal groove 330 extending in a first axis in its surface and a second longitudinal groove 332 extending in a second axis in its surface. The two grooves 330, 332 extend substantially perpendicularly to each other. Both grooves are re-entrant t-shaped so a tongue corresponding in shape to each groove may only be engaged by sliding in the respective longitudinal direction. Although component 310 is a "core" component, it does have a surface 400 which forms part of the outer surface of the sphere 300.

Component 310 is divided into two pieces 311*a* and 311*b* by a cut line 334. Cut line 334 may follow any path through the component, so long as the pieces ma y be separated and re-engaged. It will be noted that cut line 334 passes through groove 330, so when a tongue is engaged in groove 330, the pieces 311*a* and 311*b* cannot be separated.

Component 312 similarly has a first groove 340 and a second groove 342 (best seen in FIG. 5), which run at approximately 90 degrees to each other. A cut line 344 divides the component 312 into pieces 313*a* and 313*b*. This cut line 344 passes through both grooves 340 and 342 and separation of the pieces 313*a* and 313*b* can only be achieved by movement at an angle to both grooves 340 and 343. Thus when a corresponding tongue is engaged in either of grooves 340 and 342, the pieces are locked together.

The component 312 also has an extension 354*a* which form part of a tongue 354 and surfaces 402 and 404 which form part of the external surface of the sphere 300.

Figure 5:
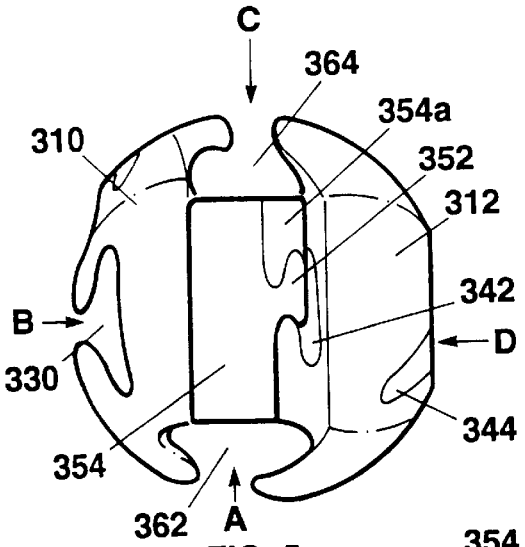
FIG. 5: shows a plan view of third embodiment of the invention partially dismembered
Figure 6:
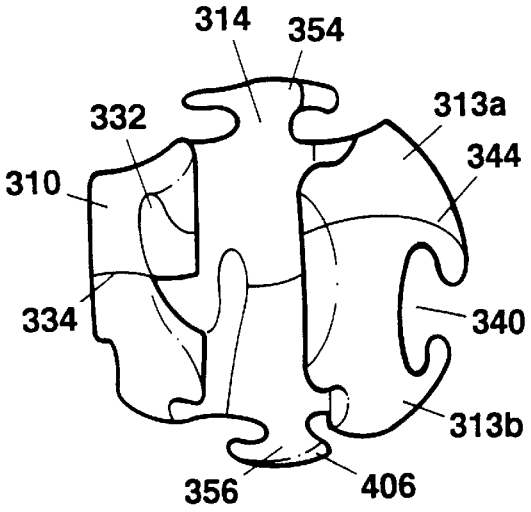
FIGS. 6 to 9: show side views of the embodiment of FIG. 5 taken in the directions of arrows A to D respectively in FIG. 5
Figure 7:
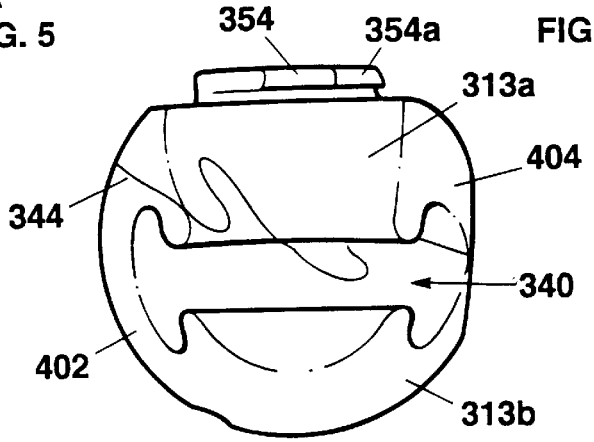
Figure 8:
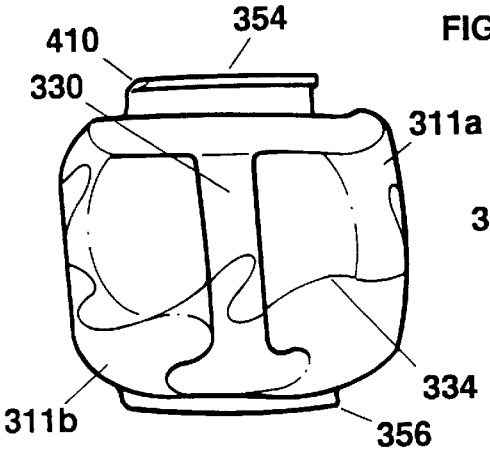
Figure 9:
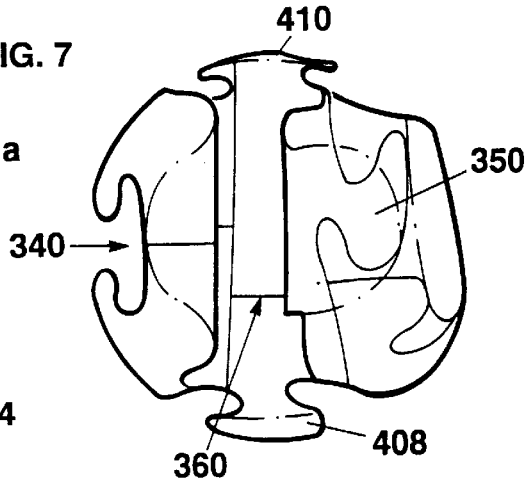
Figure 12:
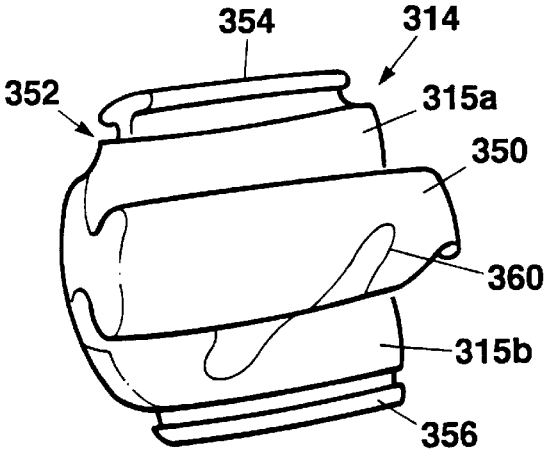
Figure 13:
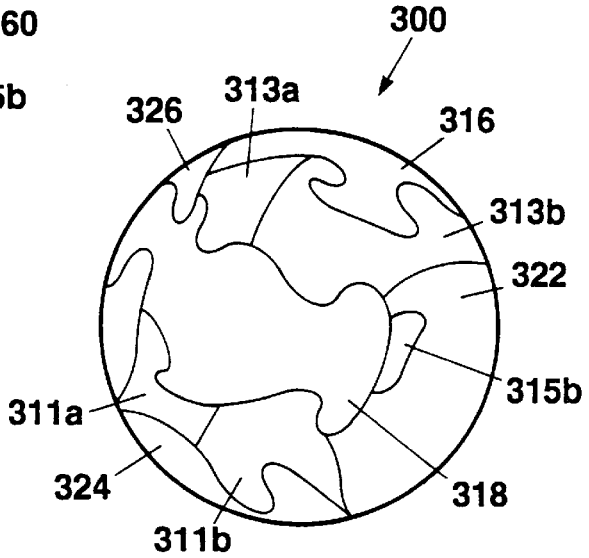
FIG. 13: shows the fully assembled third embodiment
Figure 14:
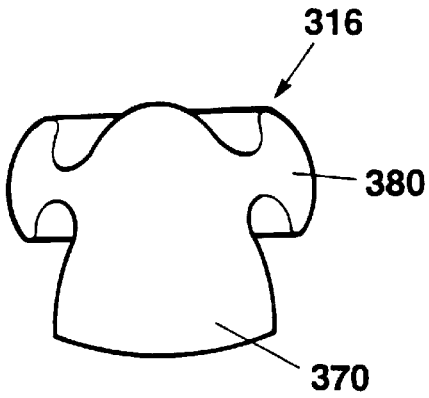
FIGS. 14 to 19: show the remaining components of the third embodiment
Figure 15:
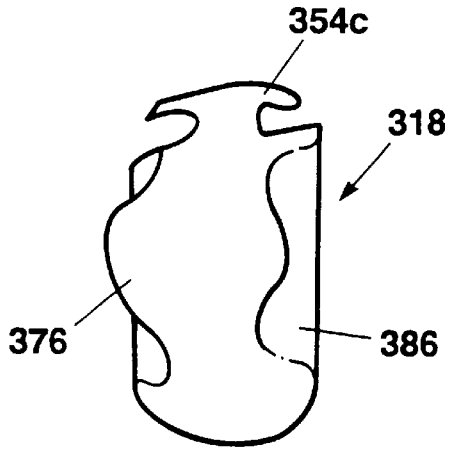
Figure 16:
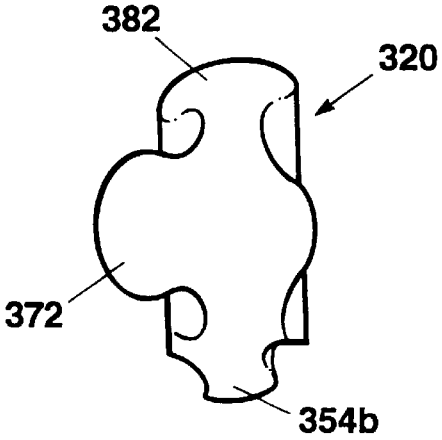
Figure 17:
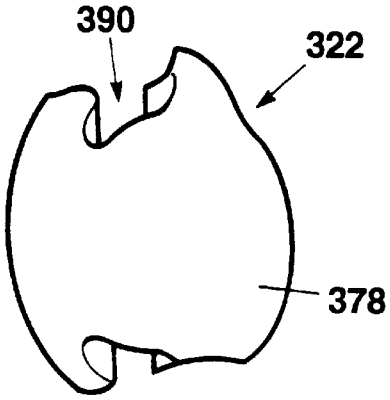
Figure 18:
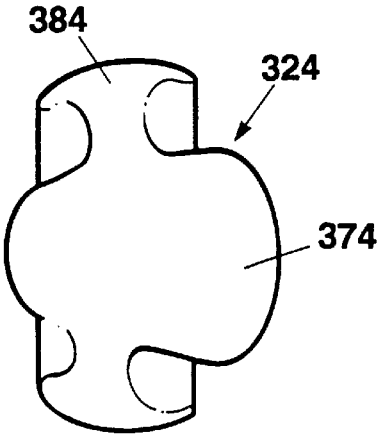
Figure 19:
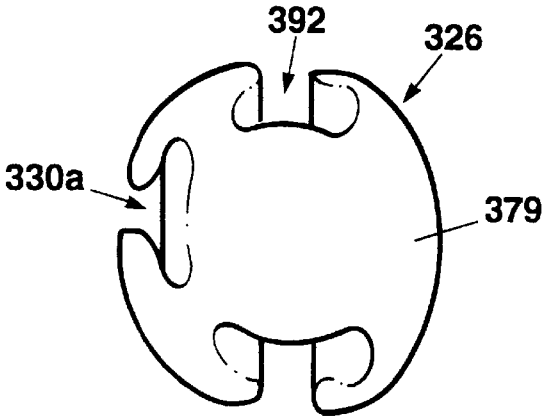

Component 314 has a horizontal tongue 350 extending along one side and a vertical tongue 352 extending on an opposite side (best seen in FIG. 5). Two horizontal tongues 354 and 356 extend along the upper and lower sides generally parallel to tongue 350 and each other, but may extend in separate directions. Component 314 is divided into pieces 315*a* and 315*b* by cut line 360. Cut line 360 passes through tongue 350 as seen in FIG. 12, so when either tongue 350 or 352 is engaged in a complementary groove, the two pieces 315*a* and 315*b* are locked together.

The component has surfaces 406, 408 and 410 on tongues 356 and 354 which form part of the external surface of the sphere 300.

Tongue 350 on component 318 and groove 332 on component 310 are complementary to each other and thus components 314 and 310 may be engaged with each other by sliding tongue 350 into groove 332, thereby locking pieces 311*a* and 311*b* together and pieces 315*a* and 315*b* together.

The tongue 352 on component 314 is complementary to groove 342 on component 312. Accordingly the component 312 may engaged with component 314 by sliding tongue 352 and groove 342 together vertically, thereby locking pieces 313*a* and 313*b* together. When in position, the extension 354*a* forms part of tongue 354.

It will be seen in FIG. 5 that when all three components 310, 312 and 314 are assembled, two further grooves 362 and 364 are defined by the three components. These two grooves are both of a reentrant type.

Referring to FIGS. 14 to 19, it will be seen that components 316, 320 and 324 are generally similar. Each of the components has an external surface 370, 372, 374 respectively and an internal tongue 380, 382 and 384 respectively. The external surfaces 380, 382 and 384 form part of the external surface of the sphere 300 whilst the tongues are sized to engage in corresponding grooves defined by the three core components 310, 312 and 314.

Component 318 also has an external surface 376 and an internal tongue 386. It also has a second tongue 354*c* which extends approximately perpendicularly to tongue 386.

Components 322 and 326 are similar in having external surfaces 378 and 379 respectively and internal grooves 390 and 392 respectively. Component 326 also has a second groove 330*a* extending substantially perpendicularly to groove 392.

The groove 390 on component 322 is complementary to tongue 356 so may be slid into engagement. When in position it prevents downward motion of component 312 but not upward motion, since it does not interlock with component 312.

Tongue 386 of component 318 is complementary to groove 362 and may be slid into groove 362 so that tongue 354*c* aligns with tongue 354 on component 314. This locks component 310 to 314 since horizontal motion of components 310 and 314 relative to each other is prevented. Also, since it overlaps component 322, it prevents horizontal motion toward component 318.

The tongue 382 on component 320 is complementary to groove 364 and may be slid into position with extension 354*b* aligned with tongue 354. Component 320 also overlaps component 322 and prevents its movement toward component 320. Thus when both components 318 and 320 are in place, component 322 is locked in position.

The groove 392 in component 326 is complementary to tongue 354 and portions 354*a, b* and *c* carried by components 312, 318 and 320. The component 326 may be slid into engagement by horizontal motion and when in position when it engages components 312, 314, 318 and 320. This locks components 312 and 314 together, since relative vertical motion is prevented by virtue of protrusions 354*a* engaging in groove 392. Similarly components 318 and 320 are locked in place by engagement of protrusions 354*b* and 354*c* with groove 392.

When in position groove 330*a* aligns with groove 330 on component 310.

The tongue 384 on component 324 is complementary to grooves 330 and 330*a* on components 310 and 326 and so component 324 may be slid into position to lock component 326 in position.

Finally, component 316 may be engaged with the other components by engaging tongue 380 into groove 34 on component 312.

Figure 20:
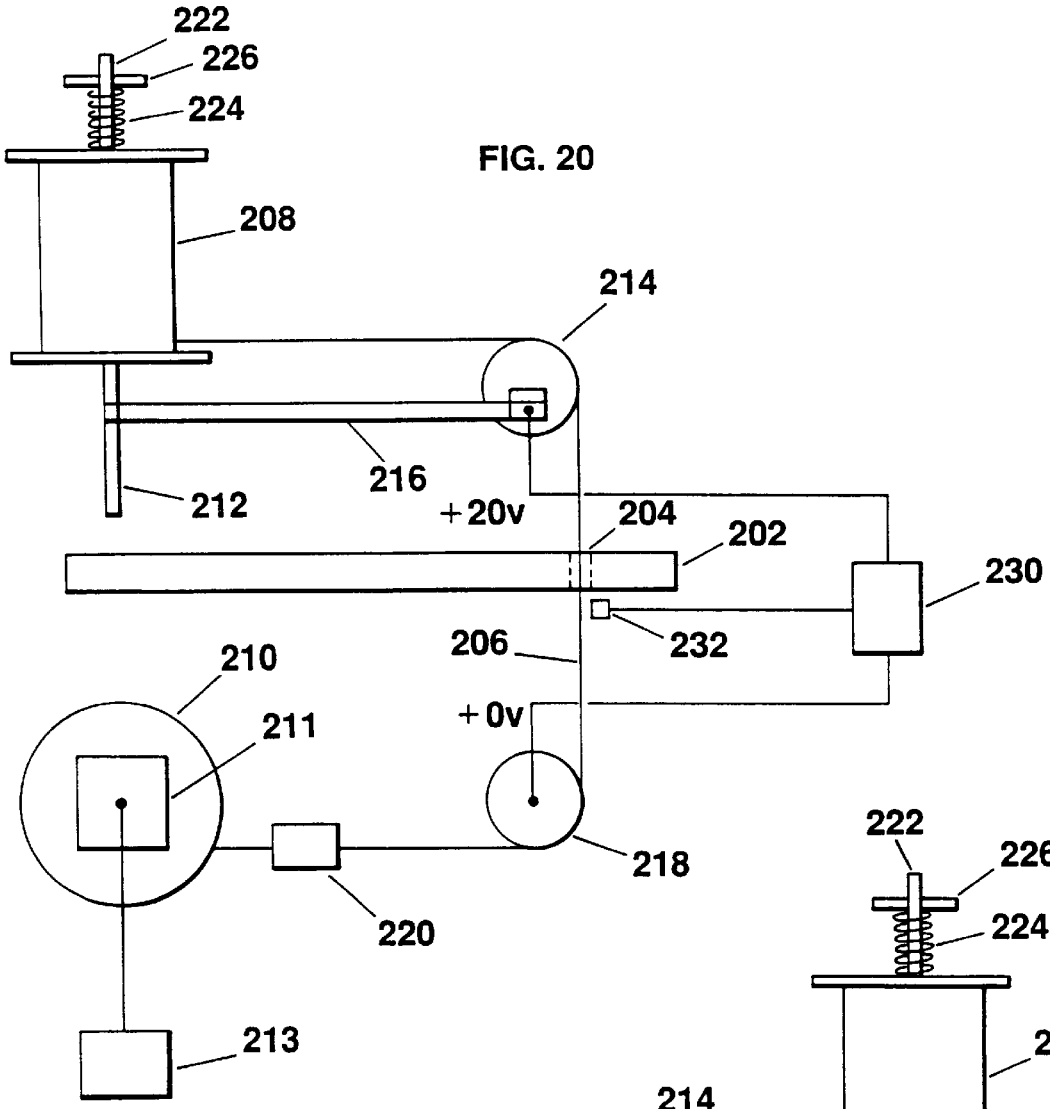
FIG. 20: is a schematic side view of a device for cutting thermoplastic materials
Figure 21:
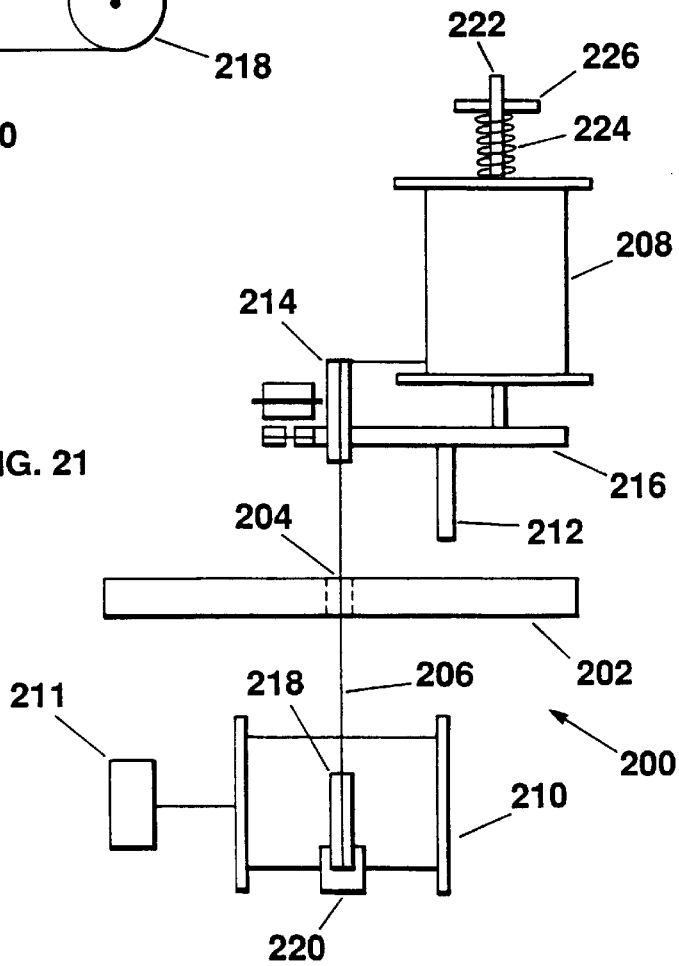
FIG. 21: is a front view of the device of FIG. 20.

The puzzles of the invention may be made of thermoplastic foams which are cut into shape by means of a hot wire device. When cut by hot wire, each puzzle will tend to be unique. If identical puzzles are desired, the components may be manufactured separately, for instance by blow or injection moulding. It will be appreciate that the puzzles may be made from other compounds, such as wood, and may be manufactured by other ways, such as laser cutting. The invention also provides a device for cutting of foam by means of a hot wire which is one way to make the puzzles described above. The cutting device is shown schematically in FIGS. 20 and 21 and is generally indicated by 200 and comprises a horizontal bed 202 upon which product to be cut is placed.

The bed 202 has a small aperture 204 passing from its upper to lower surfaces through which a metal wire 206 runs. The wire 206 runs from a supply spool 208 mounted above the bed 202 to a take-up spool 210 mounted beneath the bed 202.

The bed 206 and take-up spool 210 are fixedly mounted relative to each other upon a frame work, not shown. The supply spool 208 is mounted on a support 212 which may be raised and lowered relative to the bed 202, so as to accommodate different height pieces of foam to be cut.

The wire 206 extends from the supply spool 208 generally horizontally to an upper pulley 214. The pulley 214 is mounted on a support arm 216 which in turn is connected to the support 212. Thus the upper pulley 214 moves vertically with the supply spool 208.

The upper pulley 214 is positioned so that the wire 206 then descends vertically downwards through the aperture 204 to a lower pulley 218 mounted on the framework. The wire 206 passes around the pulley 218, through a cleaner 220 and hence to take-up spool 210. The take-up spool 210 is driven by a variable speed motor 211 such that the wire may be drawn from the supply spool 208 to the take up spool 210. The speed of the motor is controlled by controller 213. The supply spool 208 is mounted upon a vertically extending shaft 222, having a threaded upper end. A spring 224 is mounted on the shaft 222 between the spool 208 and a threaded adjuster 226 mounted on the shaft 222. When the spring 224 is compressed between spool 208 and adjusted 226, it acts as a brake to resist turning of the spool. Thus by varying the compression on the spring 224, the tension in the wire 206 as it is drawn from the spool 208 may be varied. It will be appreciated that other tensioning arrangements may be utilised.

The two pulleys 214 and 218 are of an electrically conductive material, such as brass, and are electrically isolated from the framework and support arm 216. Similarly the two spools 208 and 210 are electrically isolated from the framework and support 212. Thus the only electrical path between the two pulleys 208 and 210 is via the wire 206 running between them.

The device is provided with a controller 230 which applies a voltage potential across the two pulleys 208 and 210, thereby causing a current to flow in the wire 206. The wire 206 is a stainless steel wire of approximately 0.15 mm in diameter made by Ishibarhi of Japan. The separation of the pulleys 214 and 218 may vary between about 10 and 20 cm. At this separation a voltage of around 20 volts will cause the wire to heat to around 300 degrees celcius. As the separation of the pulleys increases a higher voltage is required to maintain a constant temperature as both resistance and surface area increase.

In use the support 212 is adjusted to provide sufficient clearance between the bed 202 and upper pulley 214 for the piece being cut. The motor speed is adjusted according to the thickness of the piece being cut and its density. Wire speed is increased with both thickness and foam density. Wire speeds of between 2 and 4 m/second have been found to be advantageous for foams about 5–10 cm in thickness and densities from 90 and 120 kg per cubic meter. If wire speed is too slow, melting foam adheres to the wire 206, causing an uneven cut, whilst too fast a wire speed causes excessive cutting.

The voltage applied across the two pulleys is also varied. The aim is to maintain the wire temperature substantially constant. Thus voltage is increased with separation of the pulleys, the thickness and the density of the foam to be cut and the motor speed. The voltage will also be varied depending on the type of foam being cut, since the melting point of the foam will vary. For instance the melting point of polystyrene foam is different from that of polyethelene based foams.

Preferably, the control of voltage may be automatic with feed back of the wire temperature to a controller 230 from a temperature sensor 232, such that wire temperature is maintained substantially constant once set. Thus it is merely necessary to set the desired temperature. The aim is that the temperature of the wire is sufficient to melt the foam but not high enough that the melted material becomes very liquid and fuses back onto the foam. It is preferable that all melted material sticks to the wire. It will be appreciated that the plastics being cut do not have a melting point per se but change from a solid to a liquid over a temperature range.

Once all the necessary controls are set and the wire is running, it is merely necessary to feed the foam to be cut against the wire 206. The temperature of the wire melts the foam and so forms a cut. Because the wire is moving the melted foam is carried on the wire a way from the foam and so the debris does not disfigure the cut. Hence a clean cut is achieved. The debris is carried on the wire 266 until the wire passes through the cleaner 220. The cleaner may merely be a bath of a solvent for the foam being cut or a pad soaked in the solvent. Alternatively a mechanical scraper may be utilised to remove the debris from the wire 206. Once all of the wire 206 has been fed from the supply spool 208 to the take up spool 210, it is merely necessary to swap the two spools and rethread the wire.

As an alternative to having two spools, it is possible to have a continuous loop of wire mounted on various pulleys. In a similar manner to a band saw.

I claim:

1. A three dimensional puzzle consisting of n components, where n is at least four, which must be coupled together in a single predetermined sequence, each $m^{th}$ component, where m is from 3 to (n−1) inclusive, being for coupling to an assembly consisting of the first to (m−1) components inclusive, each of the first to $(m-1)^{th}$ components having been assembled in sequential order, said $m^{th}$ component having:

a first engagement surface; and a second engagement surface;

said first engagement surface being complementary to a complementary engagement surface of said assembly, said complementary engagement surface being formed by second engagement surfaces of at least two of the previously coupled together (m−1) components;

said second engagement surface of each component and a portion of the surface of the assembly defining an engagement surface complementary to a first engagement surface of an (m+1) component to be coupled;

wherein each of said components must be coupled to previously coupled components in a predetermined order;

wherein none of the first to $(m-1)^{th}$ components of the assembly can be uncoupled from each other until said $m^{th}$ component is first uncoupled from said previously coupled (m−1) components; and wherein said (m+1) component cannot be coupled to an assembly of m components until said $m^{th}$ component is coupled to said previously coupled (m−1) components.

2. The puzzle of claim 1 wherein the $m^{th}$ component engages the assembly by relative movement along one or two axes only.

3. The puzzle according to claim 1 wherein the $m^{th}$ component engages the assembly by relative movement along only one axis.

4. The puzzle of claim 1 wherein the $m^{th}$ component engages the assembly by relative movement only along a first axis and the (m+1) component engages the assembly by relative movement only along a second axis which is oriented at an angle to the first axis.

5. The puzzle of claim 1 wherein the first and second engagement surfaces of each $m^{th}$ component each define part of a tongue and groove arrangement.

6. The puzzle of claim 5 wherein each said tongue and groove arrangement is a re-entrant tongue and groove arrangement.

7. The puzzle of claim 6 wherein the cross-sectional area of each said tongue and groove arrangement varies so the $m^{th}$ component engages the assembly by movement in a single direction only.

8. The puzzle of claim 1 wherein at least one of the n components is a multi-piece component.

9. The puzzle of claim 8 wherein each piece of a multi-piece component forms part of said first and/or second engagement surfaces of the component.

10. The puzzle of claim 6 wherein each piece of a multi-piece component cannot be separated from the remaining pieces of the component while the multi-piece component is engaged in position with another component.

11. The puzzle of claim 8 wherein at least two pieces of a multi-piece component may engage together by relative movement along one or two axes only.

12. The puzzle of claim 6 wherein at least two pieces of a multi-piece component may engage together by relative movement along one axis only.

* * * * *